US006318217B1

(12) United States Patent
Emhardt et al.

(10) Patent No.: US 6,318,217 B1
(45) Date of Patent: Nov. 20, 2001

(54) THROUGH-BOLT GRIPPING PLIERS WITH ADJUSTABLE OPENING WIDTH

(75) Inventors: Frank Emhardt, Wermelskirchen; Jens-Uwe Schmidt, Wuppertal; Joachim Krugmann; Sieghardt Schwandrau, both of Remscheid; Frank Suhr, Wermelskirchen, all of (DE)

(73) Assignee: VBW Vereinigte Beckersche Werkzeugfabriken GmbH & Co. (DE)

( * ) Notice: Subject to any disclaimer, the term of this patent is extended or adjusted under 35 U.S.C. 154(b) by 0 days.

(21) Appl. No.: 09/392,962

(22) Filed: Sep. 9, 1999

(51) Int. Cl.[7] ..... B25B 7/04
(52) U.S. Cl. ..... 81/411; 81/416
(58) Field of Search ..... 81/405–408, 411, 81/413, 416, 394

(56) References Cited

U.S. PATENT DOCUMENTS 4,232,573 * 11/1980 Dace, Jr. ..... 81/405
4,269,089 * 5/1981 Hastings ..... 81/411
4,296,655 * 10/1981 Tesoro ..... 81/405
4,581,960 * 4/1986 Putsch et al. ..... 81/411
4,669,340 * 6/1987 Igarashi ..... 81/416

FOREIGN PATENT DOCUMENTS 805265 5/1951 (DE) .
9218069 9/1993 (DE) .

* cited by examiner

*Primary Examiner*—Joseph J. Hail, III
*Assistant Examiner*—David B. Thomas
(74) *Attorney, Agent, or Firm*—Woodbridge & Associates, P.C.; Richard C. Woodbridge

(57) ABSTRACT

The invention relates to gripping pliers with an upper extended handle 2 and a lower extended handle 1 which comprise a handle section 9, 7 and a jaw 8, 6 positioned opposite the handle section 9, 7, with the upper extended handle 2 and the lower extended handle 1 being hingeingly supported in relation to each other in a box joint and with the joint comprising an engagement position and an adjustment position, and furthermore with an adjustment element 11 manually displaceable against a spring 19 in the direction of the swivelling axis being provided for adjusting the engagement position and the adjustment position, with the lower extended handle 1 comprising a slot in the joint area and with the upper extended handle 2 being inserted through the lower extended handle 1 in the joint area.

3 Claims, 2 Drawing Sheets

THROUGH-BOLT GRIPPING PLIERS WITH ADJUSTABLE OPENING WIDTH

BACKGROUND OF THE OF INVENTION

The present invention relates to gripping pliers with the characteristics.

Such gripping pliers are known from practical application and in particular from the printed publications DE-PS 805 265 as well as DE-92 18 069 U1. In the known gripping pliers the lower extended handle and the upper extended handle cross in a joint which comprises an elongated indexing hole. The handle which constitutes the upper extended handle when the pliers are in use, forms the lower jaw while the lower extended handle when the pliers are in use, forms the upper jaw of the pliers.

A through-bolt which forms the bearing axis of the joint is star-shaped or round in cross section and in longitudinal direction of the elongated hole engages the indexing hole located in the lower extended handle with a positive fit. A leaf spring arranged without protection provides pretension to the through-bolt in its catch position, with the said leaf spring being located on the outside of the joint opposite the through-bolt. To adjust the opening width of the known gripping pliers, the through-bolt must be pushed into the joint of the pliers, against the force of the leaf spring so that its larger cross-section is pushed out of the indexing hole. Thereafter the lower extended handle can be adjusted to the desired extent in relation to the upper extended handle. As soon as the through-bolt is no longer held, the leaf spring pushes it into the engagement position in the indexing hole, and the intended opening width of the gripping pliers is fixed. With these gripping pliers the upper extended handle comprises a slot and the lower extended handle in the area of the joint is inserted through the upper extended handle. For reasons of stability the aim is to keep the dimension of the lower extended handle in the joint area to approximately half the entire thickness, so that the load bearing surfaces of the joint components resting against the indexing bolt are approximately the same for the lower extended handle as they are for the upper extended handle.

In the case of the known gripping pliers it is therefore necessary in order to undo the indexing connection, to displace, transversely to the longitudinal plane of the pliers, the indexing bolt by an amount approximately corresponding to half the thickness of the pliers. It is thus seen as a disadvantage that this travel is relatively extensive and that the free activation end of the indexing bolt in its home position laterally protrudes significantly further out than the joint.

SUMMARY OF THE INVENTION

Starting from this it is the object of the invention to create gripping pliers with a shorter activation distance of the index bolt.

Because the lower extended handle comprises a slot in the area of the joint and the upper extended handle is inserted through the lower extended handle in the area of the joint, the adjustment element in the lower extended handle incorporating the slot can be engaged in two places spaced apart from each other. This provides the option of providing two relatively narrow bearing surfaces in the lower extended handle comprising the slot, with the adjustment position of the adjustment element being attained by displacing said adjustment element by an amount equal to the width of a bearing surface transversely to the longitudinal plane of the pliers. The activation distance (travel) for adjusting gripping pliers with a joint region designed in this way is only about half of the activation distance of conventional gripping pliers.

An adjustment element which is simple to produce results if it comprises an essentially rotationally symmetrical indexing pin. In its engagement position the indexing pin can at the same time constitute the bearing axis of the joint. Furthermore, good bearing support is provided if the indexing pin comprises a first area of smaller diameter, a second area of medium diameter and a third area of larger diameter.

A particularly robust embodiment which is also insensitive to damage and dirt provides for the lower extended handle in the region of the joint to comprise two elongated indexing holes opposing each other transversely to the plane of the pliers, of which one indexing hole comprises a number of overlapping small indexing bore holes of a first bore hole diameter and of which the other indexing hole comprises a number of overlapping large indexing bore holes of a second, larger bore hole diameter; in each instance a bore hole of the first diameter and a bore hole of the second diameter are arranged coaxially in relation to each other. This embodiment is further improved in that the indexing pin in the engagement position with its second area of medium diameter engages a bore hole of the first indexing hole, and with its third area of large diameter engages a bore hole of the second indexing hole, so that the indexing pin is fixed with a positive fit in the plane of the pliers, and the indexing pin in the adjustment position with its first area of smaller diameter is longitudinally slidable so as to engage the first indexing hole, and with its second area of medium diameter is longitudinally slidable so as to engage the second indexing hole, so that the indexing pin is altogether slidable in the plane of the pliers in longitudinal direction of the indexing holes.

Preferably, the spring is a helical spring which engages an axis-parallel bore hole of the indexing pin. By way of a buttress, in the area of the joint the upper extended handle supports a pin arranged transversely to the indexing pin, with the spring being supported by said pin which penetrates the indexing pin. With this pin the indexing pin is secured so that it cannot be lost.

Finally it is advantageous if the indexing pin at its face adjacent to the first area comprises a closure which closes off the bore hole for the helical spring, to the outside.

Below, one embodiment of the present invention is illustrated by means of a drawing, as follows:

BRIEF DESCRIPTION OF THE DRAWINGS

FIG. 1 is a lateral view of the activation side of the indexing pin, of the gripping pliers with the lower extended handle comprising a slot and with the upper extended handle being inserted through;

DETAILED DESCRIPTION OF THE INVENTION

Figure 1:
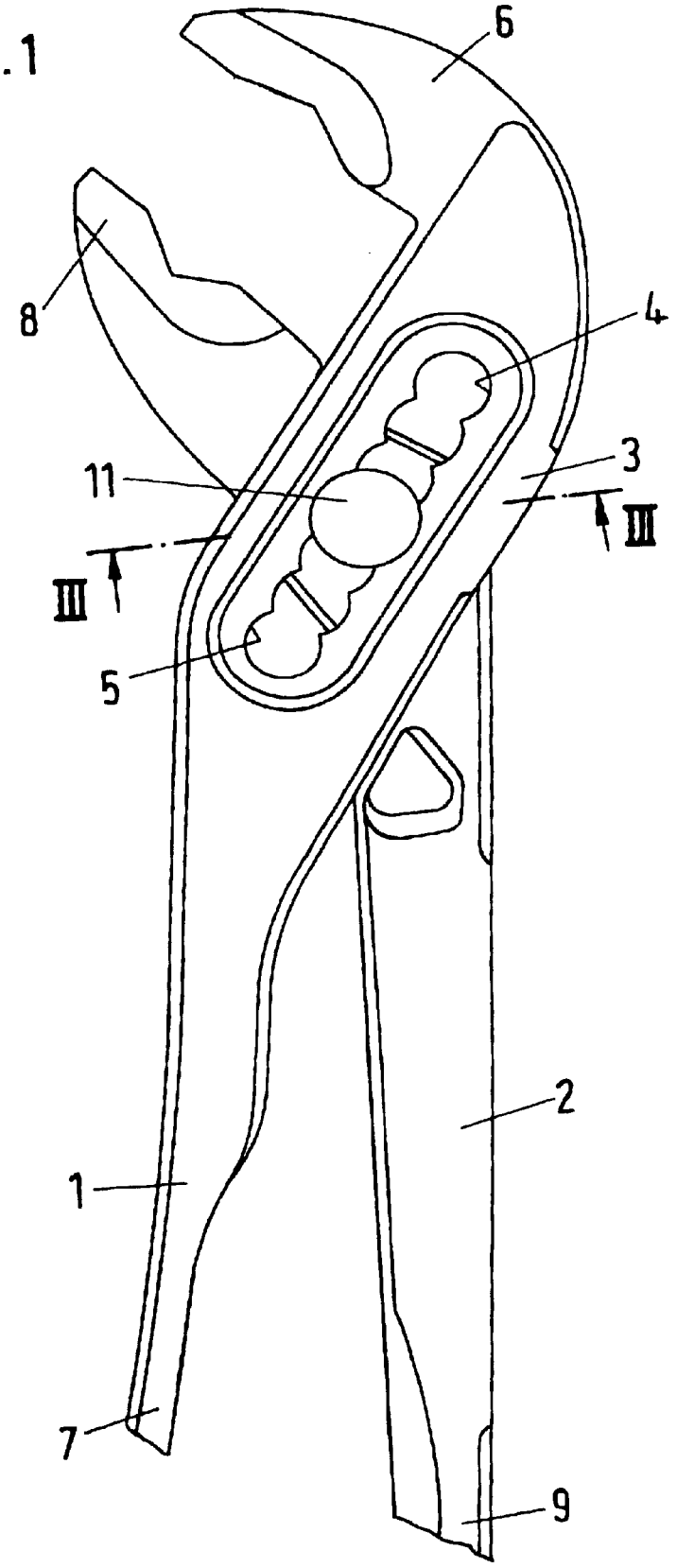

FIG. 1 shows gripping pliers according to the invention with a lower extended handle 1 comprising a slot and a upper extended handle 2 inserted through. In its joint area 3 incorporating a slot, the lower extended handle 1 comprises an elongated indexing hole 4 which in this embodiment is made up of a total of 7 round bore holes 5. The bore holes 5 are aligned side-by-side in a straight line; they partly overlap. In addition, the lower extended handle 1 comprises an upper jaw 6 as well as a handle section 7 which during use is the lower handle section. By contrast the upper extended handle 2 comprises a lower jaw 8 as well as a handle section 9 which during use is the upper handle section. Support of the upper extended handle 2 in the lower extended handle 1 is provided by an indexing pin 11 which penetrates both the lower extended handle 1 and the upper extended handle 2 and which in its engaged position, in the indexing hole 4 forms a non-slidable bearing axis for the lower extended handle 1 and the upper extended handle 2.

Figure 2:
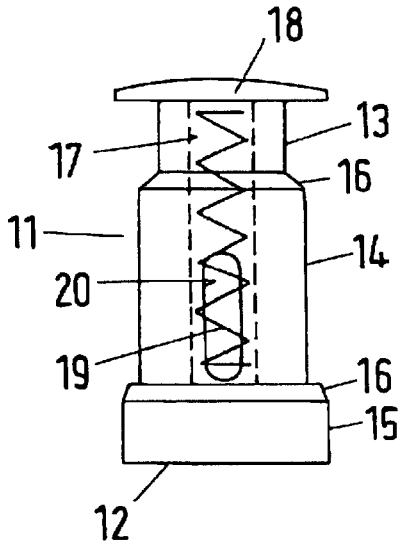
FIG. 2 is a lateral cross section of the indexing pin.

FIG. 2 is a lateral view of the indexing pin 11. The indexing pin 11 comprises an essentially rotationally symmetrical base 12 which comprises a first area 13 of smaller diameter, a second area 14 of medium diameter adjacent to the area 13, as well as an area 15 of large diameter adjacent to the area 14. Each of the areas 13 and 14 as well as 14 and 15 is joined to the other by means of a bevel 16. On the inside of the indexing bolt 11, in the middle, there is an axial blind bore hole 17 which completely penetrates the areas 13 and 14. A cap 18 screwed or bonded to the base 12 closes off the open end of the blind bore hole. A helical spring 19 is inserted into the blind bore hole 17. The base 12 of the indexing pin 11 is penetrated by an elongated hole 20 in transverse direction i.e. in radial direction.

Figure 3:
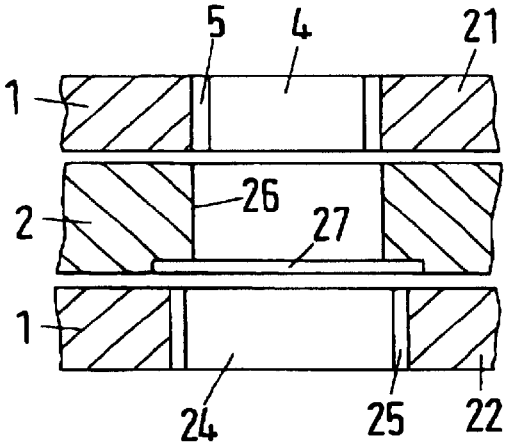
FIG. 3 is a truncated view of a cross-section of the joint area of the gripping pliers according to the invention.

FIG. 3 shows the joint area of the gripping pliers according to FIG. 1 approximately in a cross-section along the line III—III in FIG. 1. In this area the lower extended handle 1 comprises an upper cheek 21 as well as a lower cheek 22. The upper cheek 21 bears the indexing hole 4 with its overlapping bore holes 5, while the lower cheek 22 comprises a corresponding indexing hole 24 as well as overlapping bore holes 25. In this joint area the upper extended handle 2 passes between the two cheeks 21 and 22 of the lower extended handle 1. In addition, the upper extended handle 2 comprises a round through bore hole 26 which at one end comprises an associated pin 27 aligned transversely over the bore hole 26.

The indexing hole 4 with its overlapping bore holes 5 is designed in such a way that the diameter of each bore hole 5 corresponds to the interior diameter of the bore hole 26 of the upper extended handle 2, while in the overlap area of every two adjacent bore holes 5 the clear diameter of the indexing hole 2 is narrowed. This design of an indexing hole is generally known from adjustable water pump pliers. However, the inside diameter of the indexing hole 24 of the lower cheek 22 is larger. Here the inside diameter of the overlap area between each two bore holes 25 is the same as the bore hole diameter of the bore holes 5 and 26 while the actual bore diameter of the bore holes 25 is larger than this.

Figure 4:
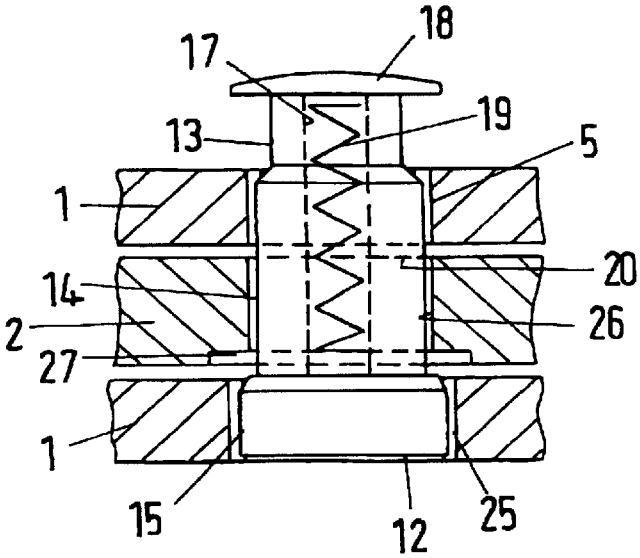
FIG. 4 shows the indexing pin according to FIG. 2, inserted in the joint area according to FIG. 3, in its engagement position.

FIG. 4 shows the indexing pin according to FIG. 2 (rotated on its axis by 90°), inserted in the joint area according to FIG. 3. The same reference numbers are used for elements already described. In the engagement position shown, the indexing pin 12 with its area 13 of smaller diameter is positioned outside the joint of the pliers, while the area 14 of medium diameter penetrates an indexing hole 5 as well as the bore hole 26 of the upper extended handle 2. By contrast, the area 15 is positioned in a bore hole 25 of the lower extended handle 1. The pin 27 penetrates the elongated hole 20 of the indexing bolt 11 so that one end of the helical spring 19 can rest against the pin 27 while the other end can rest against the head 18. In this way the helical spring 19 pre-tensions the indexing bolt 11 in the joint to this engagement position.

To adjust the opening width of the gripping pliers shown, axial pressure is exerted onto the head 18 of the indexing bolt 11 so that the indexing bolt 11 is displaced against the tension of the helical spring. Consequently the area 15 of larger diameter leaves the bore hole 25, the area 14 of medium diameter is displaced from the bore hole 5 into the bore hole 25 while it remains positioned in the bore hole 26 of the upper extended handle. The area 13 of smaller diameter enters the bore hole 5 instead of the area 14. Since now the next-smaller areas 14 or 15 instead of the areas 15 or 14 are resting in the indexing holes 4 or 24, the indexing bolt can be displaced in longitudinal direction of the indexing holes 4, 24 in order to be brought into the desired position in this way. If the pressure on the head 18 of the indexing bolt 11 is reduced, then the helical spring 19 pre-tensions the indexing bolt again into its engagement position, with the areas 14 and 15 engaging the selected bore holes 5 and 25 of the indexing holes 4 and 24. When the bore hole axes are not exactly covered, the bevels 16 facilitate insertion of the indexing bolt into the respective bore holes. In the engagement position, the joint is now secured in the direction of the indexing holes 4 and 24 so that it cannot slide.

Furthermore this embodiment shows that displacement of the indexing bolt in axial direction by the amount equal to the thickness of a cheek 21 or 22 is sufficient to completely unlock the joint of the pliers. If the joint of the pliers is dimensioned such that equal areas are carrying equal loads, then the width of each cheek 21 or 22 can be kept smaller than the joint area of the upper extended handle. For example each cheek 21 and 22 can amount to a quarter of the entire thickness of the joint, while the thickness of the upper extended handle in this area amounts to half. With this configuration it is thus possible to define the height of the area 13 to be a quarter of the entire thickness of the joint in this area, so that the axial displacement for unlocking also only needs to be a quarter of the thickness. With the known gripping pliers with adjustable locking opening, the required activation travel of the indexing element is twice as much.

What is claimed is:

1. A gripping pliers with an upper extended handle (2) and a lower extended handle (1) which comprise a handle section (9, 7) and a jaw (8, 6) positioned opposite the handle section (9, 7), with the upper extended handle (2) and the lower extended handle (1) being hingeingly supported in relation to each other in a box joint and wherein the joint includes an engagement position and an adjustment position, and furthermore with an indexing pin (11) manually displaceable against a spring (19) in the direction of the joint for adjusting between the engagement position and the adjustment position, where the lower and upper handles of the pliers move in a planar motion, the lower extended handle (1) includes a slot in said joint area;

the upper extended handle (2) is inserted through the lower extended handle (1) in said joint area; and, the indexing pin (11) includes a first area (13), a second area (14) and a third area (15), such that the first area (13) has a first diameter that is smaller than that of the second area (14) and the third area (14) has a larger diameter that is larger than that of the second area (15).

2. A gripping pliers according to claim 1, characterised in that the lower extended handle (1) in the region of the joint includes two indexing holes (4,24) opposing each other perpendicular to the plane of plier motion and where one indexing hole (4) includes a number of overlapping small indexing bore holes (5) of a first bore hole diameter and of which the other indexing hole (24) includes a number of overlapping large indexing bore holes (25) of a second bore hole diameter that is larger than the first bore hole diameter; wherein for each instance, a small indexing hole (5) of the first diameter and a large indexing hole (25) of the second diameter are arranged coaxially in relation to each other.

3. A gripping pliers according to claim 2, characterized in that the indexing pin is in engagement position when the second area (14) of the indexing pin (11) engages one of the small indexing bore hole and the third area (15) of the indexing pin engages one of the bore holes (25) of the second indexing hole (24), so that the indexing pin (11) is fixed with a positive fit in the plane of plier motion; and, the indexing pin (11) is in adjustment position when the first area (13) of the indexing pin is longitudinally slidable so as to engage the first indexing hole (4), and the second area (14) of the indexing pin is longitudinally slidable so as to engage the second indexing hole (24), permitting the indexing pin (11) to slide in the plane of plier motion in longitudinal direction of the indexing holes (24).

* * * * *